United States Patent [19]

Nakabayashi et al.

[11] 4,441,260

[45] Apr. 10, 1984

[54] PROCESS AND APPARATUS FOR DEHYDRATING ORGANIC SOLID MATERIAL

[75] Inventors: Yasuyuki Nakabayashi, Yokohama; Yoshio Matsura, Funabashi; Michio Kurihara, Mitaka; Takao Kamei, Ashiya; Akira Nakamura, Akashi; Keiichi Komai, Akashi; Akira Simotamari, Akashi; Izumi Matsuno, Kobe, all of Japan

[73] Assignees: Electric Power Development Co. Ltd., Tokyo; Kawasaki Jukogyo Kabushiki Kaisha, Kobe, both of Japan

[21] Appl. No.: 343,771

[22] Filed: Jan. 28, 1982

[51] Int. Cl.[3] ..... F26B 3/04

[52] U.S. Cl. ..... 34/15; 34/35; 34/80

[58] Field of Search ..... 34/9, 15, 22, 35, 36, 34/86, 218; 110/224; 209/236; 134/104, 109; 44/1 G, 2

[56] References Cited

U.S. PATENT DOCUMENTS 2,726,079 12/1955 Sheets ..... 209/236
3,007,254 11/1961 Schuster ..... 34/35

FOREIGN PATENT DOCUMENTS 558524 1/1944 United Kingdom ..... 209/36

*Primary Examiner*—Larry I. Schwartz
*Assistant Examiner*—David W. Westphal
*Attorney, Agent, or Firm*—Dennis P. Clarke

[57] ABSTRACT

A process for dehydrating water-containing organic solid material which comprises steps of introducing the material into a pressure vessel, applying saturated steam to said vessel to heat the material so that water in the material be removed and mixed with condensate of the steam to be exhausted from the vessel as a waste water. The process is characterized by a step of charging material of relatively large particle size at a bottom portion of the vessel and of relatively small particle size on the material of large particle size. The process makes it possible to dehydrate relatively fine particles of material by utilizing liquid form dehydration phenomemon.

4 Claims, 1 Drawing Figure

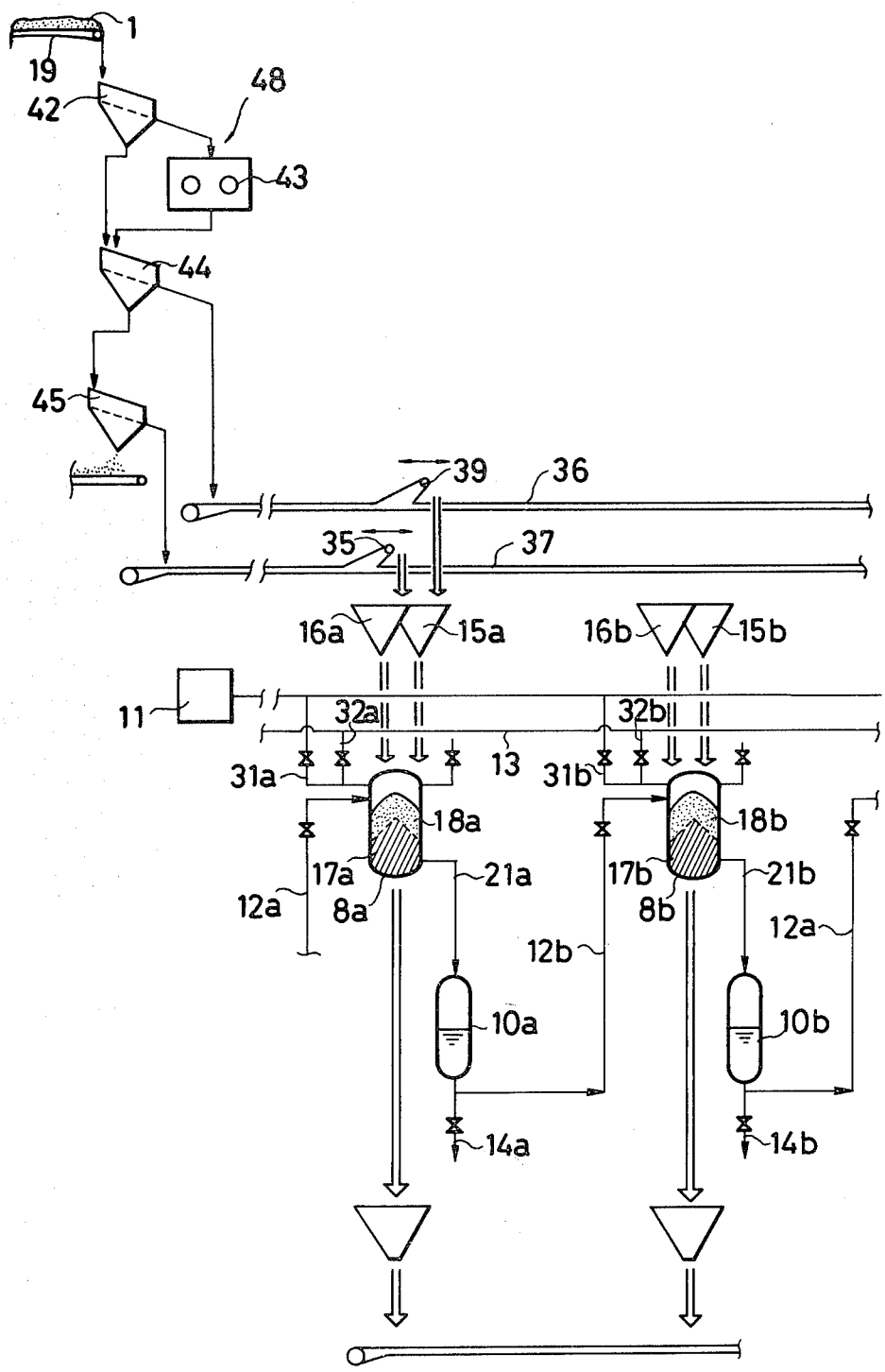
1
19
42
48
43
44
45
39
36
35
37
16a
15a
16b
15b
11
32a
32b
13
31a
31b
18a
18b
17a
17b
21a
21b
12a
8a
8b
12b
12a
10a
10b
14a
14b

PROCESS AND APPARATUS FOR DEHYDRATING ORGANIC SOLID MATERIAL

The present invention relates to a dehydrating process and apparatus, and more particularly to a process and apparatus for dehydrating porous organic solid materials such as brown coals which can be dehydrated under an atmosphere in which water cannot be evaporated.

Hithertofore, dehydration of solid material such as brown coal has been carried out by an evaporation process such as a dry air process or an indirect heating process. These processes, however, have disadvantages in that the heat consumption is excessive, that the material has to be crushed in advance and that the dust is produced upon dehydration. Further, fire is likely to occur in the dehydrated material.

In order to eliminate the above disadvantages, a saturated steam dehydration process has been developed. The process utilizes the liquid form dehydration phenomenon in which physical and chemical changes are produced in a porous solid material such as brown coal when it is heated under a non-evaporating atmosphere with the result that water in liquid form is removed from pores in the solid material. In actual practice, the process is carried out by using a plurality of pressure vessels in which batch processes are proceeded with phase differences between the vessels. In one typical process, the brown coal to be dehydrated is sieved to remove fine particles and charged into the vessels with time differences. Each of the vessels is then closed and supplied with saturated steam to have the material heated thereby so that water in the coal is removed in liquid form and mixed with condensed steam to produce hot water which is a mixture of the water removed from the material and the condensed steam. The hot water is then introduced into a hot water reservoir. The vessel is thereafter depressurized so that the residual water in the brown coal is further evaporated.

The liquid form dehydrating process is characterized in that lumps of organic solid material of a substantial size can be dehydrated as they are, however, there are problems when it is applied to a dehydration of fine particles because water is constrained in spaces between particles under a capillary action and may be drawn into the material when the vessel is depressurized. Particularly, in case where the layer of the material is of a substantial thickness, a large amount of water is separated from the material and flown downwards. Such water is apt to be caught between fine coal particles which are compacted in lower part of the coal layer. Further, the fine particles of the material may be carried by the hot water out of the vessel and may sometimes cause clogging of pipe lines. Thus, in the liquid form dehydrating process, the material is at first sieved as described previously to remove fine particles. Therefore, in case where the ratio of the fine particles is relatively large and there is no way of utilizing such fine particles, there will be a significant disadvantage in economical standpoint. For example, a certain kind of brown coal from Australia includes more than 50% of fine particles having particle diameter less than 30 mm.

It is therefore an object of the present invention to provide a liquid form dehydrating process which can be applied even to material of relatively small particle size.

Another object of the present invention is to provide an apparatus which can be used in carrying out such process.

According to the present invention, the above and other objects can be accomplished in a process for dehydrating water-containing organic solid material which comprises step of inroducing the material into a pressure vessel, applying saturated steam to said vessel to heat the material so that water in the material be removed and mixed with condensate of the steam to be exhausted from the vessel as a waste water, by a step of charging material of relatively large particle size at a bottom portion of the vessel and of relatively small particle size on the material of large particle size. In another aspect of the present invention, there is provided an apparatus for providing such stratified material charge.

According to the features of the present invention, it is unlikely that the fine particles are compacted in the material layer, and the amount of water which flows through the layer of the fine particles is small. Therefore, the water will not be caught in the material of the fine particles.

The above and other objects and features of the present invention will become apparent from the following descriptions of a preferred embodiment taking reference to the accompanying drawing which fragmentarily shows an example of the system for carrying out the process of the present invention.

Referring to the drawing, the dehydrating system includes a belt conveyor 19 for transferring brown coal 1 to be dehydrated to a sieving device 48. The sieving device 48 includes a primary sieve 42, a crusher 43, a secondary sieve 44 and a ternary sieve 45 and functions to classify the particles according to particle size and remove fine particles which are unsuitable for the liquid from dehydration. Beneath the sieving device 48, there is provided a pair of parallel belt conveyors 36 and 37 which extend above a series of pressure vessels **8*a* and 8*b*. The number of the pressure vessels may be determined as desired. The sieve 44 supplies relatively large lumps of coal to the conveyor 36 whereas the sieve 45 supplies relatively fine lumps or particles of coal to the conveyor 37. The conveyor 36 is provided with a tripper 39 which distributes the material on the conveyor 36 to the respective ones of the vessels 8*a* and 8*b*. Similarly, the conveyor 37 is provided with a tripper 35. Hoppers 15*a* and 16*a* are provided between the conveyors 36 and 37, respectively, and the vessel 8*a* for receiving the material from the conveyors 36 and 37, respectively, and supplying it to the vessel 8*a* at desired times. Similarly, hoppers 15*b* and 16*b* are provided between the conveyors 36 and 37, respectively, and the vessel 8*b***.

Referring specifically to the process carried out in the vessel **8*a*, the vessel is at first charged with the relatively large lumps of material such as brown coal to be dehydrated from the conveyor 36 as shown by the reference numeral 17*a*, and thereafter with relatively fine particles of material from the conveyor 37 as shown by the reference numeral 18*a*. Then, the vessel 8*a* is closed and after an appropriate preheating process supplied with saturated steam which is passed from an external steam source 11 through a pipe 31*a* to the vessel 8*a*. The material is thus heated and water in the material is removed in liquid form. The consumed steam is condensed in this process and mixed with the water from the material. The vessel 8*a* is provided with a water reservoir 10*a* which is connected with the vessel 8*a*** through a pipe 21*a*. The hot water in the vessel 8*a* is therefore introduced into the reservoir 10*a*. The vessel 8*b* is also provided with a water reservoir 10*b* which is connected with the vessel 8*b* through a pipe 21*b*. After the liquid form dehydrating process, the vessel 8*a* is depressurized so that the residual water in the coal is evaporated. Thereafter, the dehydrated coal is taken out of the vessel 8*a*.

The vessels 8*a* and 8*b* are connected with each other at top portions thereof through pipes 32*a* and 32*b* and a pipe 13 so that the steam in the vessel 8*a* can be transferred therethrough to the vessel next to the vessel 8*b* after the liquid form dehydration in the vessel 8*a* is finished to thereby preheat the material charged in the vessel. The reservoir 10*a* is connected through a pipe 12*b* with the next vessel 8*b*. The hot water in the reservoir 10*a* is therefore transferred through the pipe 12*b* to the vessel 8*b* by opening the valve in the pipe 12*b* when the dehydration in the vessel 8*a* is finished and the steam is transferred from the vessel 8*a* to the vessel next to the vessel 8*b*, to thereby preheat the material in the vessel 8*b*. The hot water thus supplied to the vessel 8*b* flows down the vessel 8*b* and is passed through the pipe 21*b* to the reservoir 10*b*. The reservoirs 10*a* and 10*b* are provided with discharge pipes 14*a* and 14*b*, respectively. The water introduced into the reservoir 10*b* as described above is discharged through the pipe 14*b*.

According to the process described above, relatively fine particles of material to be dehydrated are accumulated on a layer of relatively large lumps of material. Therefore, the amount of water which flows through the layer 18*a* of relatively fine particles is not so large and further the particles in the layer 18*a* will not be compacted, so that it is possible to prevent decrease in the dehydration rate. The thickness of the layer 18*a* may be appropriately determined to obtain a desired result. The lower layer 17*a* of relatively large lumps of material functions to prevent flow out of the fine particles so that it is possible to prevent a loss of material.

As an example, brown coal from Alaska is dehydrated in accordance with the process of the present invention. The brown coal of particle size larger than 5 mm is classified into two classes in accordance with the particle size, the first class including the material of particle size between 5 and 10 mm and the second class of particle size larger than 10 mm. The material of the second class is charged into the pressure vessel at the bottom portion thereof to form a lower layer and the material of the first class is charged on the lower layer to form an upper layer. After a dehydration process, the result is compared with that obtained by a conventional process in which the same quantity of material of particle size larger than 5 mm is dehydrated without classification. It has been found that the process according to the present invention achieves a 12.5% decrease in the residual water as compared with the conventional process. In the conventional process, the material has to be of particle size larger than 10 mm in order to achieve a desirable result whereas according to the process of the present invention the particle size of down to 5 mm can be used. Since the material of particle size of 5 to 10 mm amounts to approximately 10% of the total amount of the material, the process of the present invention provides a significant improvement in economy.

In should of course be noted that the process of the present invention is not limited to an application to a dehydration of brown coal but it may be applied to any porous organic solid material. Thus, it should be understood that the invention is not limited to the details of the examples as described but changes and modifications may be made without departing from the scope of the appended claims.

We claim:

1. In a process for dehydrating water-containing organic solid material comprising the steps of introducing the material into a pressure vessel, applying saturated steam to said vessel to heat the material so that water in the material is removed and mixed with condensate of the steam to be exhausted from the vessel as a waste water, the improvement comprising classifying the solid material into a first group of relatively larger size particles and a second group of relatively smaller size particles, charging the first group of relatively larger size particles into the pressure vessel so that a bottom portion of the vessel is composed of a layer of relatively larger size particles, then changing the second group of relatively smaller size particles on the layer of relatively larger size particles.

2. An apparatus for dehydrating water-containing organic solid material comprising pressure vessel means, saturated steam source means for providing a supply of saturated steam to said pressure vessel means, means for classifying said water containing organic solid material into a first group of relatively larger size particles and a second group of relatively smaller size particles, first hopper means for receiving the first group of relatively larger size particles, second hopper means for receiving the second group of relatively smaller size particles, means for causing said first hopper means to charge said first group of relatively larger size particles into said pressure vessel means, means for causing said second hopper means to charge said second group of relatively smaller size particles into said pressure vessel after completion of first hopper charging so that a layer of first hopper charging so that a layer of relatively larger size particles is formed beneath a layer of relatively smaller size particles.

3. An apparatus in accordance with claim 2 which includes sieve means for classifying the material into first group of relatively larger size particles and second group of relatively smaller size particles, said sieve means being associated with said first and second hopper means so that the first group of material is supplied to the first hopper means and the second group of material to the second hopper means.

4. An apparatus in accordance with claim 3 in which conveyor means is provided between said sieve means and said first and second hopper means.

* * * * *